United States Patent [19]

Holloway

[11] Patent Number: 4,983,059

[45] Date of Patent: Jan. 8, 1991

[54] DISPENSER FOR COSMETIC PREPARATIONS

[75] Inventor: Thomas F. Holloway, Southbury, Conn.

[73] Assignee: Risdon Corporation, Naugatuck, Conn.

[21] Appl. No.: 381,582

[22] Filed: Jul. 18, 1989

[51] Int. Cl.[5] ..... A45D 40/12; A45D 40/06

[52] U.S. Cl. ..... 401/78; 401/74; 401/98; 401/87

[58] Field of Search ..... 401/53, 68, 75, 77, 401/78, 86, 74, 87, 98, 97

[56] References Cited

U.S. PATENT DOCUMENTS

| | | | |
|---|---|---|---|
| 2,461,790 | 2/1949 | Vaughn | 401/79 |
| 2,797,802 | 7/1957 | Hopgood | 206/56 |
| 2,838,170 | 6/1958 | Isele | 206/56 |
| 2,999,585 | 9/1961 | Hultgren | 206/56 |
| 3,083,822 | 4/1963 | Clark | 206/56 |
| 3,838,170 | 6/1958 | Isele | 206/56 |
| 4,166,707 | 9/1979 | Zawacki et al. | 401/68 |
| 4,380,402 | 4/1983 | Andrews et al. | 401/74 |
| 4,422,545 | 12/1983 | Kadoory | 401/98 |

FOREIGN PATENT DOCUMENTS

| | | | |
|---|---|---|---|
| 671829 | 12/1929 | France | 401/78 |
| 1005782 | 4/1952 | France | 401/78 |
| 1133390 | 3/1957 | France | 401/78 |
| 2406972 | 6/1979 | France | 401/78 |

*Primary Examiner*—Steven A. Bratlie

*Attorney, Agent, or Firm*—St. Onge, Steward, Johnston & Reens

[57] ABSTRACT

An improved cosmetic preparation dispenser is provided which comprises a hollow body forming an elongated chamber for containing the preparation therein in a shape corresponding to the chamber. A holder member is slidably mounted inside the hollow body for holding one end of the preparation while being moved along a line of travel either in a first or second direction within the hollow body to respectively extend and retract the preparation through an opening at one end of the hollow body. Means are also provided spaced along the line of travel for lockingly detaining the holder member at at least two stations spaced along the line of travel, the lockingly detaining means being releasable under operator control to permit the holder member to be moved from station to station, whereby the preparation can be lockingly retained at predetermined stations along the line of travel.

7 Claims, 3 Drawing Sheets

DISPENSER FOR COSMETIC PREPARATIONS

I. FIELD OF THE INVENTION

The present invention relates to dispensers for cosmetic preparations. More particularly, a dispenser is provided wherein a cosmetic preparation, such as a column of lipstick, can be extended from the dispenser and be lockingly retained for loading and displaying the lipstick column.

II. BACKGROUND OF THE INVENTION

Prior art dispensers for cosmetic preparations such as lipstick are well known. Such dispensers are typically cylindrical structures with a hollow inner body providing a tubular chamber for holding a tube of lipstick, which is fixedly mounted at one end thereof to an elevator cup that moves up and down the chamber to extend or retract the lipstick from an opening in one end of the inner body. One or more lugs on the elevator cup ride in and follow a slot formed in said inner body and extending longitudinally in an axial direction along the inner body length. This slot maintains constant angular orientation between the hollow inner body and the lipstick column mounted in the elevator cup. A cylindrical internally threaded base is mounted on the radially outward side of the inner body, such that the inner body, the elevator cup, and the threaded base all share a common axis. The lug on the elevator cup extends to the inner body slot to be engaged by the threads, such that when the base is rotated about the common axis relative to the inner body, the lug is urged either upward or downward along said chamber by the action of said threads, depending upon the direction of relative rotation, to thereby either extend or retract said lipstick. It is also known to put an aesthetically-designed tubular cover further around the base, a nose piece over the opening in said inner body, and a removable top for capping said nose piece. The nose piece may have an end portion shaped at an angle to the common axis for aesthetic reasons, with the tip of the lipstick column correspondingly shaped. Another reason for the angle in the nose is that it helps maintain an angular shape to the product during consumer use and makes it easier to apply. The high side of the nose piece also helps support the product during use and reduces breakage.

A disadvantage of this prior art assembly resides in the tendency of the lugs on the elevator cup to jump out of the threads or otherwise become disengaged during loading, shipping, and display. Additionally, the various extended or retracted conditions of the lipstick often cannot be reliably maintained for loading, shipping and display.

For example, the lipstick manufacturer typically loads or fills the dispenser when the elevator cup is all the way in the retracted or "down" position. The lipstick tip is then shaped to alignment with the nose piece. Because it may be desirable to visually display a small length of the lipstick column by turning the base a small amount to slightly extend the lipstick, the dispenser is so adjusted and then packed in a blister pack for shipping and later display at a point of purchase. However, during normal impacts of shipping and handling, the elevator cup lugs may jump out of the threads or the cup gets otherwise forced down, resulting in no visual display of the lipstick column.

III. SUMMARY OF THE INVENTION

An improved cosmetic preparation dispenser in the preferred embodiment comprises an inner body with an elevator cup mounted therein The elevator cup has a lug that follows a slot formed in the inner body. The improvement is that the slot has formed therein a pair of notches suitably shaped for lockingly receiving said lug therein to detain said elevator cup against unwanted motion back and forth through the inner body such as may tend to occur during shipping and handling The notches are spaced apart in an axial direction, such that a first notch corresponds to a loading position and the second notch positioned further towards the nose piece corresponds to a display position. The notches are formed in a slot portion that is offset in the region of the notches, and the notches themselves are aligned with a straight portion of the slot that extends further along the inner body for maintaining the proper angular orientation with said elevator cup, such that said lipstick is maintained in the same angular orientation with respect to the nosepiece, regardless of whether the lug is in the first notch for loading, the second notch for display, or the straight portion of the slot for general use by a consumer or operator.

It is an object of the present invention to provide an improved dispenser for cosmetic preparations such as lipstick.

It is a further object to provide such a dispenser that can be lockingly retained in one position for loading and lockingly retained in a second position for display of a tip portion of a lipstick column.

Other objects and advantages of the present invention will be apparent from the following brief description of the drawings and detailed description of the preferred embodiment.

IV. BRIEF DESCRIPTION OF DRAWINGS

V. DETAILED DESCRIPTION OF THE PREFERRED EMBODIMENT

Figure 1:
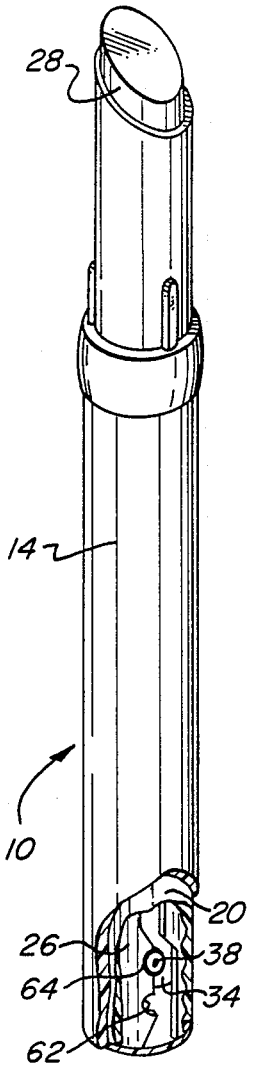
FIG. 1 is a perspective view of the assembled dispenser of the present invention, with a partial cutaway.
Figure 2:
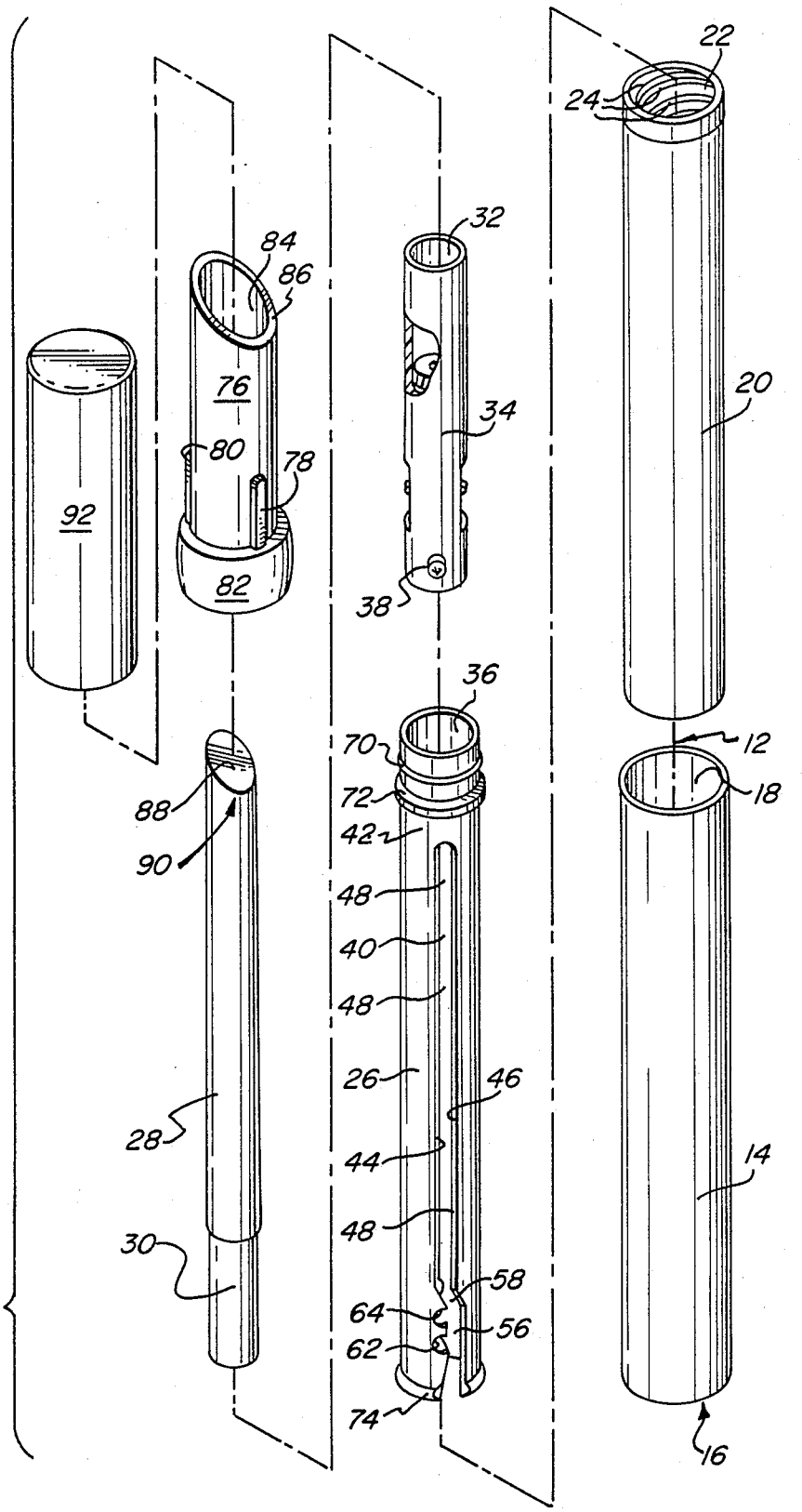
FIG. 2 is an exploded view of the dispenser of FIG. 1.

With reference now to FIGS. 1 and 2, a preferred embodiment of the improved dispenser of the present invention is shown in both assembled form at 10 in FIG. 1 and also in exploded form in FIG. 2. In FIG. 2, broken line 12 indicates not only the common axis of the dispenser, but also the general manner and order in which the various components fit one into the other.

A cylindrical cover 14, typically closed at bottom 16 and open at top 18, receives inwardly threaded member or base 20. Base 20 is open at 22 and has internal threads 24 that spiral in conventional fashion along substantially the entire length of base 20. Cover 14 and base 20 are fixedly attached, such as for example by gluing, to rotate about axis 12 in unison. Inner body 26, such as a hollow body or guide tube, is received axially into base 20. Inner body 26 forms an elongated chamber or passageway 36 and contains the column of cosmetic preparation, typically for example lipstick column 28 mounted at end 30 thereof into open end 32 of a carriage such as elevator cup or holder member 34, which in turn is slidably fitted with appropriate clearance for sliding into interior chamber 36 formed by inner body 26.

Figure 8:
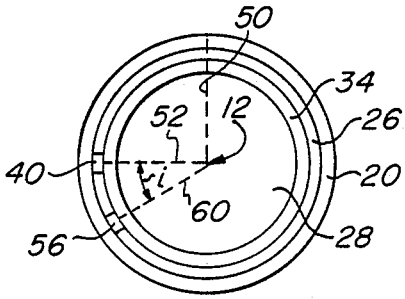
FIG. 8 is a schematic top view of one aspect of the dispenser of the present invention.

Following means such as lug 38 on cup 34 fits into slot or track 40 on inner body 26. Track 40 extends completely through the tubular wall 42 of inner body 26 and is formed by generally opposing track sidewalls 44 and 46 that provide opposing guide surfaces for lug 38. Track 40 has a straight track portion 48 at a constant angular displacement about axis 12, such as from an arbitrarily chosen reference radial line 50 as indicated by the radial line 52 in FIG. 8. Track 40 also has an offset track portion 56, which is connected to straight track portion 48 by an angled transition track portion 58. Offset track portion 56 is angularly displaced by a predetermined angle i as shown in FIG. 8 by radial line 60. Offset track 56 has a width 57 suitable for receiving lug 38 therethrough in a sliding fashion. It is understood that FIG. 8 is conceptual only to help describe the concept of angular orientation about common axis 12.

Figure 3:
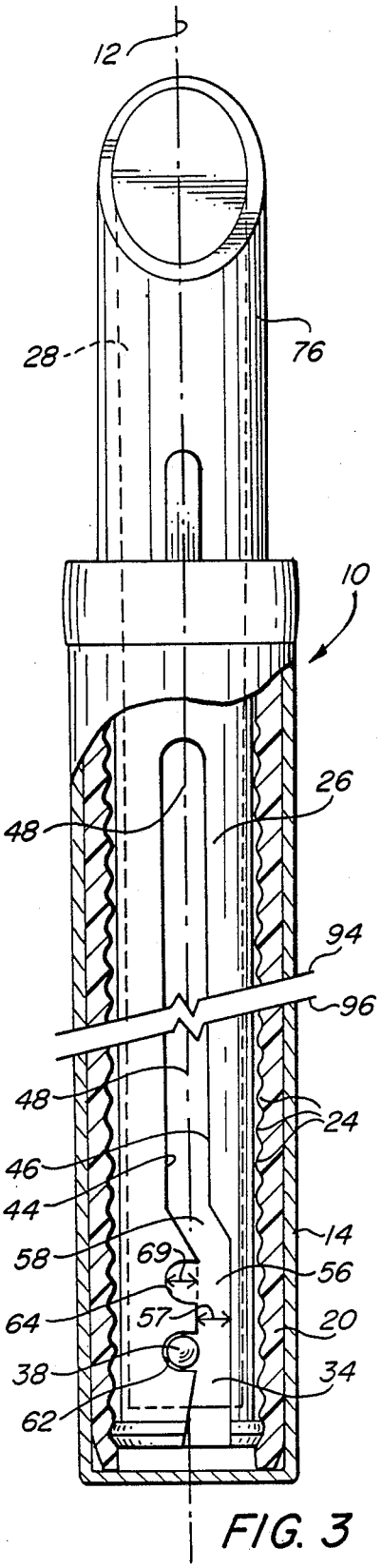
FIG. 3 is a side view with partial cutaway of the dispenser of FIG. 1 lockingly retained in a retracted or first notch position for loading.

Indentations such as notches 62 and 64 comprise retaining means for lockingly receiving lug 38 therein to retain cup 34 in first and second positions for loading and displaying respectively. Each notch has opposing shoulders such as shoulders 66 and 68 for notch 62 shown in FIG. 6 and a sufficient depth 69 for receiving lug 38 therebetween as shown in FIG. 3 to lockingly retain the cup 34 from being moved either back or forth in an axial direction. The operation of the dispenser and the use of these notches will be described in further detail below.

Inner body 26 has a plurality of routinely shaped flanges, 70 72, and,. 74 for conventional assembly with base 20 and nose piece 76. An opening such as for example provided by nose piece 76 with conventional structures 78 and 80 has a rim 82 for snappingly engaging inner body 26 in the region of flanges 70 and 72 in a fixed angular orientation about said common axis 12. Nose piece 76 is also hollow therethrough as indicated at 84 for passing column 28 therethrough as column 28 is extended or retracted, either up or down, as is traditional for dispensing lipstick. Nose piece 76 has a shaped tip portion, such as preferably the angular cut 86 that also corresponds to a similar angular cut 88 for tip 90 of stick 28. A cap 92 can be fitted onto the nose piece 76 to cover the open end of dispenser 10.

The cover 14, threaded base 20, inner body 26, cup 34, nose piece 76, and cap 92 can be made from any suitable material, such as for example plastic or metal.

With reference now to FIGS. 3, 4, 5, 6, and 7, where the same figure numbers indicate the same structures, the method of operation of the dispenser of the present invention can be described.

At FIG. 3, the dispenser 10 is in a condition for loading, wherein the lug 38 is nested in notch 62 and thereby lockingly received against movement in either direction along axis 12. Break lines 94 and 96 are used to indicate that the length of dispenser 10 can be of course varied. The dispenser 10 is generally loaded by inserting lipstick column 28 downwardly through said nose piece 76 until end 30 is firmly engaged in a cuplike hollow 98 formed in one end 32 of cup 34. A plurality of conventional rib-like structures such as at 100 and 102 are provided for grippingly engaging end 30 of lipstick column 28. Also frictional braking means 104 formed on cup 34 are provided for frictionally engaging radially inward tubular walls of inner body 26 to provide for smoother travel of said cup back and forth.

After lipstick column 28 is firmly in place the column is trimmed against the shaped end 86 of nose piece 76 to give a uniform and aesthetically pleasing slanted appearance. As explained in further detail below, this corresponding angular orientation between the nose piece 76 and tip 90 is to be maintained during a lipstick display condition and also for at least a part of the useful life of said lipstick column 28 as it is consumed, although it is understood that after use by a consumer or operator commences, the shape of the lipstick tip 90 will of course be unpredictably variable.

Since cup 34 is retained at a first station in this retracted position by lug 38 being lockingly received in notch 62, the danger that said column 28 may be jostled out of nose piece 76 and therefore subject to breakage or other damage is therefore lessened.

Figure 4:
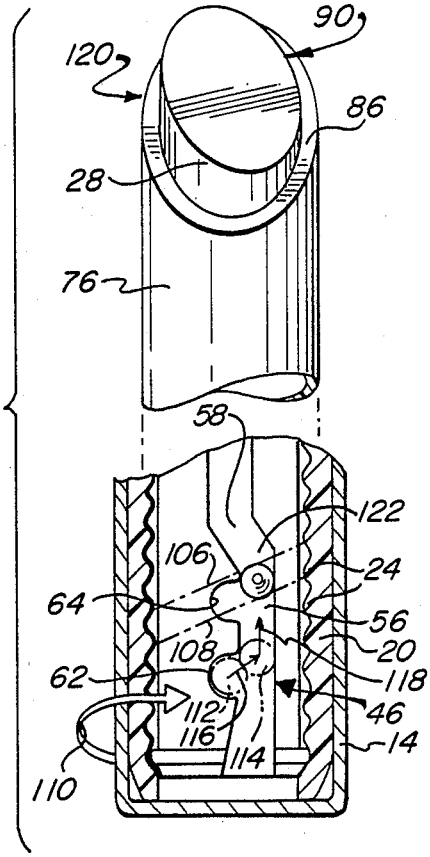
FIG. 4 is a side view with partial cutaway of the dispenser of FIG. 1 illustrating operation of the dispenser from the first notch to a second notch.

FIG. 4 illustrates a transitional state illustrating how the lipstick column is turned up to be lockingly retained in a second station corresponding to second notch 64. The inclination of threads 24 is shown generally by broken lines 106 and 108. As cover 14 and threaded base 20 are rotated in unison in a direction as indicated by arrow 110, lug 38 is urged out of notch 62 into offset track portion 56, as indicated by arrow 116 and the phantom renderings of lug 38 at 112 and 114, toward opposing guide surface or track sidewall 46. As threaded base member 20 is rotated further in the direction of arrow 110, lug 38 and hence cup 34 are pushed along by the inclined threads in a direction toward nose piece 76, as indicated by arrow 118. It should be noted that, when lug 38 is in offset track position 56, tip 90 is rotated somewhat with respect to and therefore out of alignment with shaped end 86 of nosepiece 76 as indicated generally at 120. When lug 38 reaches the position across from notch 64 as indicated at 122, by reversing the direction of rotation momentarily as shown by arroW 124 in FIG. 5, the lug 38 can be backed into and nested in second notch 64 for being lockingly received therein to retain the cup 34 against further movement along said axis 12.

And, because notches 62 and 64 have notch floors 126 and 128 aligned with track sidewall 44, tip 90 is now properly realigned with slant 86 on nose piece 76 as indicated at 121.

Figure 6:
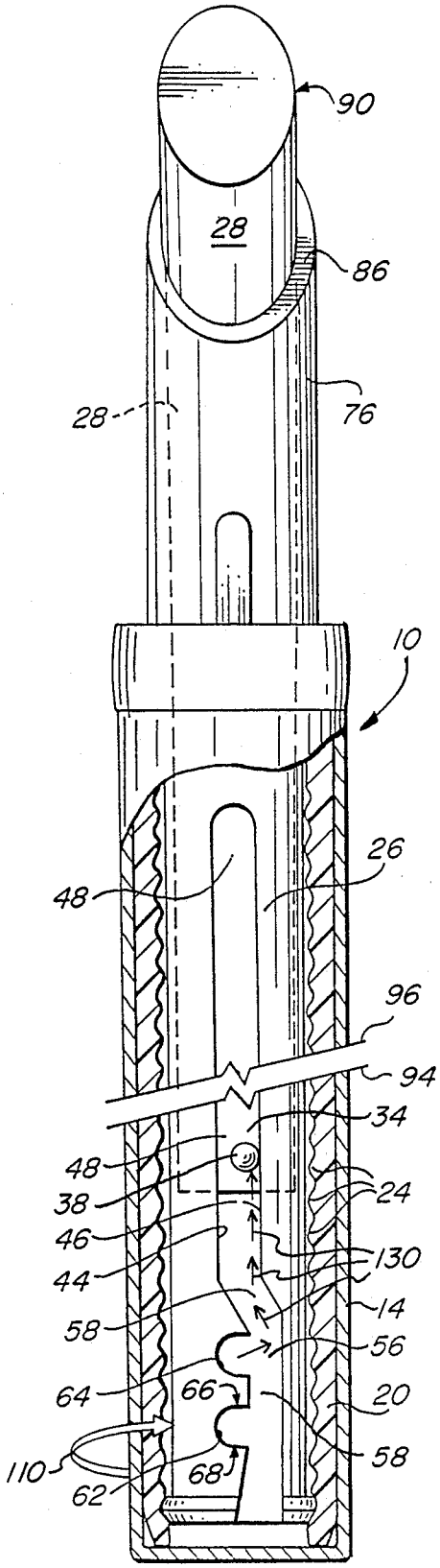
FIG. 6 is a side view with partial cutaway of the dispenser of FIG. 1 in an extended position for use by the consumer operator.

FIG. 6 shows the lipstick column 28 extended for use by a consumer or operator. By turning cover 14 and base 20 in unison further in the direction of arrow 110, lug 38 is similarly urged out of notch 64 in the direction of arrows 130 to follow guide surface or track sidewall 46 up the tubular member 26 and move the column 28 along a path corresponding generally to common axis 12.

Figure 5:
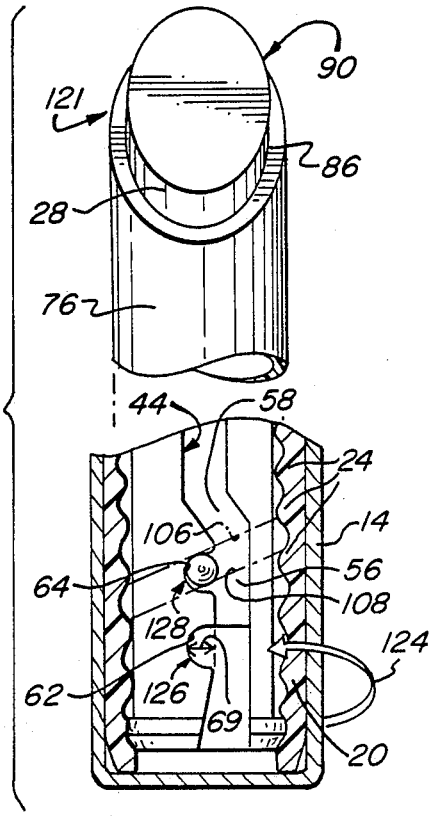
FIG. 5 is a side view with partial cutaway of the dispenser of FIG. 1 lockingly retained in the second notch position for displaying a tip portion of a lipstick column.
Figure 7:
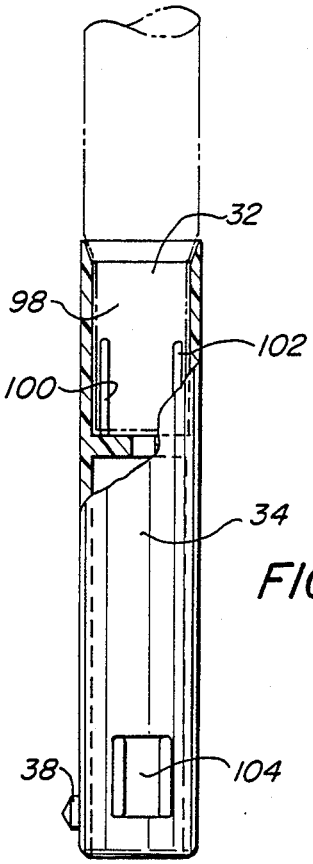
FIG. 7 is a side view of the carriage of the present invention.

It is understood that cup 34 can be withdrawn backwards by turning cover 14 and base 20 in the reverse direction as shown by arrow 124 in FIG. 5 so that lug 38 will reverse its direction and follow track sidewall 44 back in a reverse direction and into notch 64 as indicated in FIG. 5. However, the cup is retained in this second station and cannot be retracted further by turning the cover 14 and base 20 in either direction.

It is understood that terms such as "up", "down", "forward", "reverse", "lift", and "lower" are terms indicated to show relative motion only and are not intended to be limiting of the present invention in any way.

Having thus described several embodiments of the invention, its advantages can be appreciated. Variations from the illustrated forms can be made without departing from the scope of the invention.

What is claimed is:

1. A cosmetic dispenser, comprising:

a tubular base having upper and lower ends and an axis, and a internal spiral thread extending along a substantial length of said base;

a tubular inner body having upper and lower ends and a wall, said inner body being fitted into said tubular base, said inner body being provided with a track extending through the wall of said inner body along a substantial length of said inner body, said track comprising an upper straight track portion having an axis, and a lower offset track portion having an axis offset from the axis of said upper straight track portion, said lower offset track portion having at least one notch connecting with an extending laterally from said offset track portion to a location beneath and substantially in alignment with said axis of said upper straight track portion;

means for retaining said inner body and said base together while permitting rotation of either said inner body or base relative to the other;

an elevator cup for receiving a cosmetic material, said elevator cup being fitted inside said inner body, said elevator cup being provided with a radially outwardly extending lug, said lug being sized to fit into and engaging said track of said inner body and said spiral thread of said base for axial movement of said elevator cup by relative rotation of said base and inner body, said lug being engageable with said at least one notch to lock said elevator cup in place;

a tubular nose piece secured to said upper end of said inner body, said nose piece having a dispensing opening at an upper end thereof which is non-perpendicular to the axis of said base.

2. A cosmetic dispenser in accordance with claim 1, wherein said lower offset track portion comprises a lower offset straight track portion extending generally parallel to but offset from said upper straight track portion, and an angled transition track portion connecting said upper straight track portion to said lower offset straight track portion.

3. A cosmetic dispenser in accordance with claim 1, wherein there are two said notches connecting with and extending from said offset track portion, the first said notch being located adjacent the lower end of said inner body for engaging said lug and thereby locking said elevator cup in a cosmetic loading position, the second said notch being located above said first notch for engaging said lug and thereby locking said elevator cup in a cosmetic display position.

4. A cosmetic dispenser in accordance with claim 4, further comprising a tubular base cover having an open end and a closed end, said base being fitted inside and secured to said tubular base cover with said upper end of said base located adjacent said open end of said base cover and said lower end of said base located adjacent said closed end of said base cover.

5. A cosmetic dispenser in accordance with claim 4, further comprising a cap sized for friction fit onto the upper end of said nose piece.

6. A cosmetic dispenser, comprising:

a tubular base having upper and lower ends and an axis, and an internal spiral thread extending along a substantial length of said base;

a tubular base cover having an open end and a closed end, said base being fitted inside and secured to said tubular base cover with said upper end of said base located adjacent said open end of said base cover and said lower end of said base located adjacent said closed end of said base cover;

a tubular inner body having upper and lower ends and a wall, said inner body being fitted into said tubular base, said inner body being provided with a track extending through the wall of said inner body along a substantial length of said inner body, said track comprising an upper straight track portion having an axis, and a lower track portion having a lower offset straight track portion having an axis extending generally parallel to but offset from said axis of said upper straight track portion and an angled transition track portion connecting said upper straight track portion to said lower offset straight track portion, said lower offset straight track portion having first and second notches connecting with and extending laterally from said lower offset straight track portion to a location beneath and substantially in alignment with said axis of said upper straight track portion, the first said notch being located adjacent the lower end of said inner body, the second said notch being located above said first notch;

means for retaining said inner body and said base together while permitting rotation of either said inner body or base relative to the other;

an elevator cup for receiving a cosmetic material, said elevator cup being fitted inside said inner body, said elevator cup being provided with a radially outwardly extending lug, said lug being sized to fit into and engaging said track of said inner body and said spiral thread of said base for axial movement of said elevator cup by relative rotation of said base and inner body, and being engageable with said first notch for locking said elevator cup in a cosmetic loading position and being engageable with said second notch for locking said elevator cup in a cosmetic display position;

a tubular nose piece secured to said upper end of said inner body, said nose piece having a dispensing opening at an upper end thereof which is non-perpendicular to the axis of base;

whereby said elevator cup and a cosmetic contained therein will be aligned with said nose piece dispensing opening in said locked loading and display positions when said lug is engaged with said notches.

7. A cosmetic dispenser in accordance with claim 6, further comprising a cop sized for friction fit onto the upper end of said nose piece.

* * * * *